United States Patent [19]

Merkle, Jr.

[11] 3,958,519

[45] May 25, 1976

[54] HIGH TEMPERATURE FURNACE CONSTRUCTION AND HANGERS THEREFOR

[75] Inventor: Frank P. Merkle, Jr., Long Grove, Ill.

[73] Assignee: Merkle & Associates, Inc., Palatine, Ill.

[22] Filed: Feb. 18, 1975

[21] Appl. No.: 550,217

[52] U.S. Cl. ..... 110/99 R; 248/228

[51] Int. Cl.[2] ..... F22M 5/04

[58] Field of Search ..... 110/99 R, 99 A, 1 A; 248/228

[56] References Cited

UNITED STATES PATENTS

| | | | |
|---|---|---|---|
| 1,623,860 | 4/1927 | Benson | 110/99 |
| 2,400,827 | 5/1946 | Jones | 110/99 |
| 2,446,766 | 8/1948 | Hosbein et al. | 110/99 |

*Primary Examiner*—Kenneth W. Sprague
*Attorney, Agent, or Firm*—Thomas W. Speckman

[57] ABSTRACT

A high temperature refractory structure having refractory brick lining including a support frame, a plurality of spaced hanger beams inwardly from the support frame and having opposed flanges, a plurality of spaced hanger beam clips engaging one of the hanger beam flanges for attachment to a support frame, a plurality of refractory hangers engaging the other of the hanger beam flanges, and a plurality of refractory bricks supported by the refractory hangers, the refractory hangers engaging hanger flanges of refractory bricks thereby supporting the refractory brick lining, the refractory brick hanger flanges being at approximately right angles to the hanger beam flanges. Also disclosed is a sheet metal beam clip of substantially U-shape for fastening one beam at right angles to another. Also disclosed is a sheet metal refractory hanger of two interlocked substantially U-shapes having their axis at about right angles to each other, one of the U-shapes engaging a beam flange and the other U-shape engaging hanger flanges of a refractory brick.

10 Claims, 5 Drawing Figures

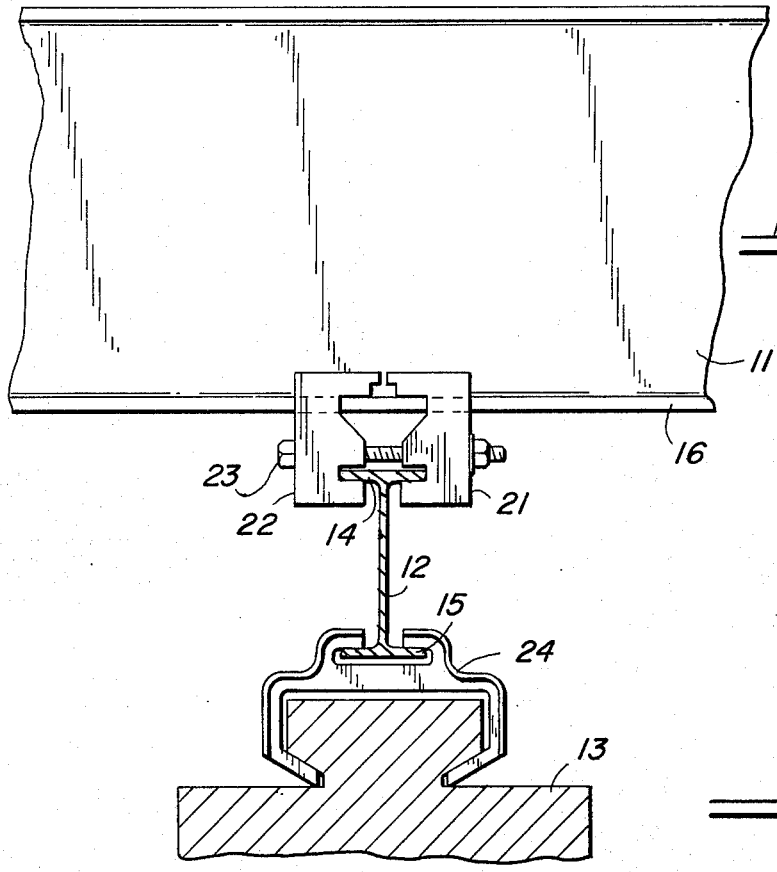
FIG. 1
FIG. 2
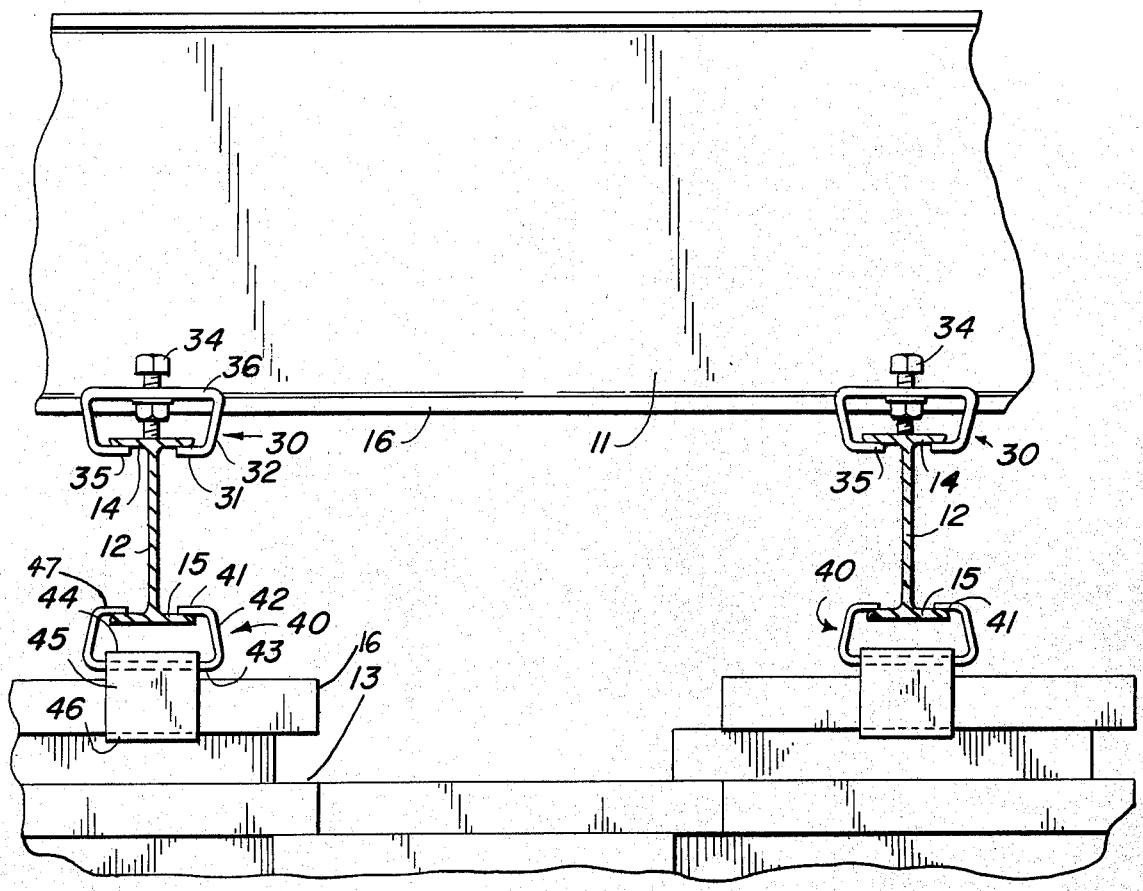

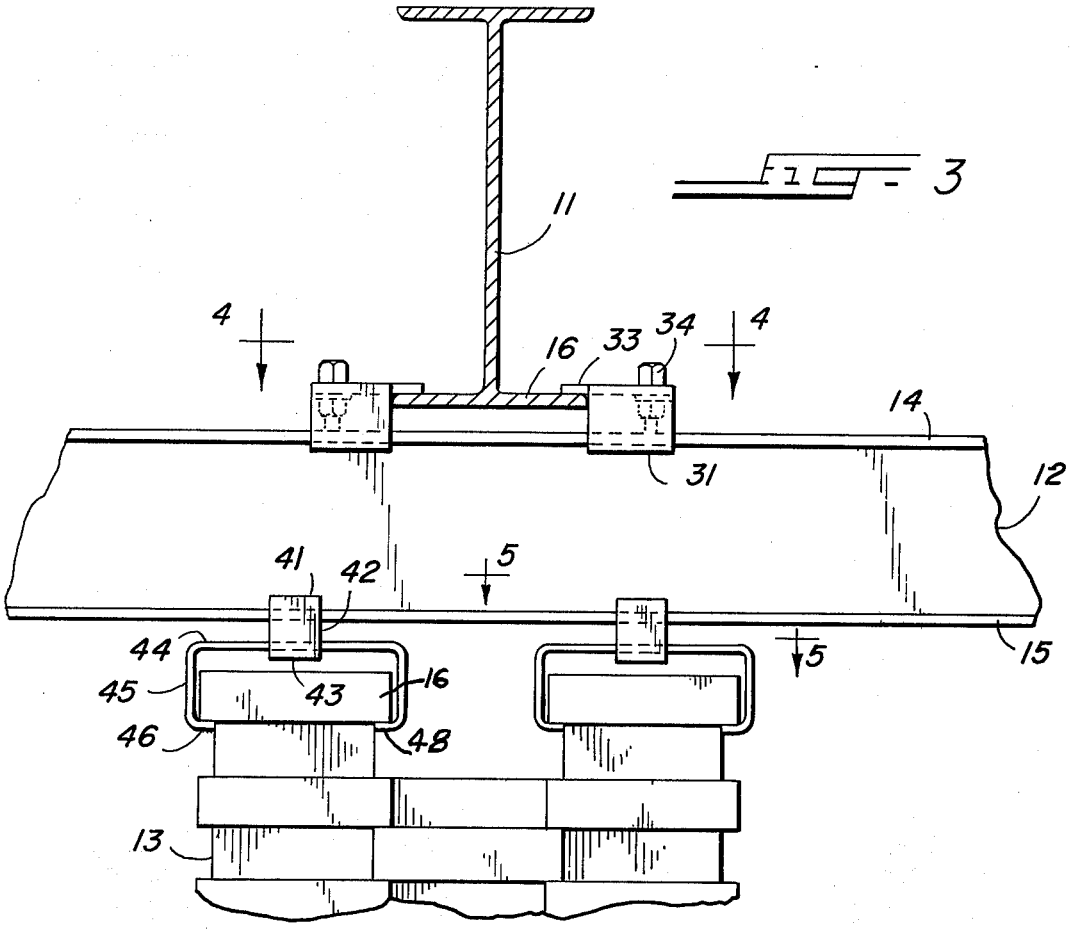
FIG. 3
FIG. 4
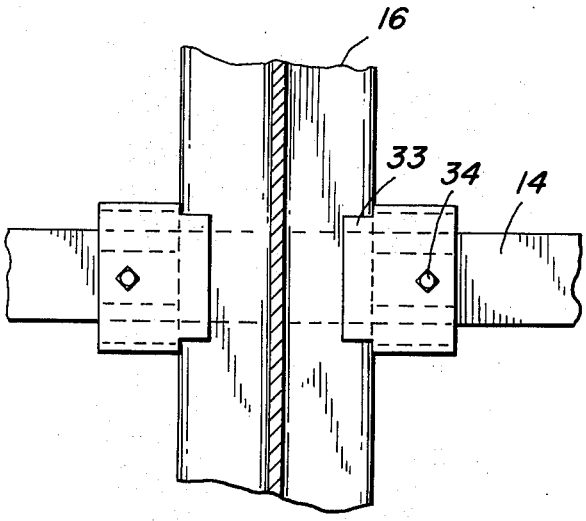
FIG. 5
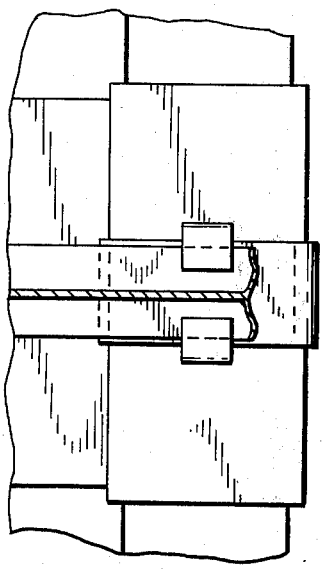

HIGH TEMPERATURE FURNACE CONSTRUCTION AND HANGERS THEREFOR

This invention relates to high temperature furnace construction used in a wide variety of industries including the production of steel, glass and petrochemicals. Such furnaces are constructed of refractory firebrick or tile and supported by metal structural framework. The furnace construction of this invention may be used in monolithic and suspended or tieback refractory structures.

High temperature furnaces require interior structures of heat-resistant refractory firebrick or tiles. Such interior structures are heavy and require support, whether a roof structure or sidewall structure, by a substantial support frame which is constructed from structural steel. The support frame is conventionally made up of large I-beams or wide flange beams with smaller I-beams, such as three inch I-beams, serving as hanger beams at right angles to the beams of the support frame. The hanger beams are attached to the support frame usually with cast hanger beam clips on one flange of the hanger beam and the refractory brick is held by refractory hangers on the opposite flange of the hanger beam. Many of the presently used refractory hangers are castings which must be slid over the end of the I-beam and then the refractory slid into the end of the refractory hanger in such a manner that hanger flanges on the refractory brick engage the refractory hanger and are parallel to the flanges of the hanger beam.

FIG. 1 shows an exemplary previously used refractory brick anchoring system. The support frame I-beam is shown as 11 having flange 16 over which hanger beam clips 21 and 22 are engaged. Hanger beam clips 21 and 22 must be slid over flange 16 from the end of beam 11 and each engage one side of flange 14 of hanger beam 12. Hanger beam clips 21 and 22 are secured by bolt 23. Opposite hanger beam flange 15 engages one slot of refractory hanger 24 by refractory hanger 24 being slid over flange 15 from the end of hanger beam 12. The opposite slot of refractory hanger 24 engages hanger flanges of refractory brick 13.

All prior construction known to the inventor has utilized combinations of components such that the hanger flanges of the refractory brick are parallel to the hanger beam flanges. In addition to the frequent requirement of sliding the refractory hanger over the end of the hanger beam to engage it on the hanger beam flange, installation has been hampered in such systems by the refractory brick sliding out of the refractory hanger on a sloping roof or vibrating out on a flat roof. Further, the cast form of the refractory hanger is unduly expensive and specially desired heat-resistant materials have not been practical when cast or machined shapes have been necessary.

It is seen that hanger beam clips of the prior construction also suffer serious disadvantages in that they have been of cast metal.

The cast iron is also brittle and the refractory hangers and the beam clips of the prior art frequently break due to vibration. The cast iron is also heavy and presents a greater hazard in falling during assembly.

Another prior method of hanging the refractory bricks to the hanger beams which overcomes some of the above disadvantages is a bent rod-type (ice tong) refractory hanger which is made up of two separate pieces. One of the rod-type refractory hangers extends under the hanger flange on one side of the refractory brick and hooks on the opposite hanger beam flange. The other hanger extends under the hanger flange on the other side of the refractory brick and hooks on the other hanger beam flange causing a tightening action as weight is applied by the refractory brick. These hangers, while they do prevent the refractory brick from sliding out of the hanger, cause breaking of refractory bricks due to immovability of the hanger bracks and the forces which result from expansion upon heating the furnace.

It is an object of this invention to overcome the above disadvantages.

It is another object of this invention to provide a high temperature furnace construction wherein the hanger flanges on the refractory bricks are at approximately 90° to the flanges on the hanger beams.

It is another object of this invention to provide a non-cast fabricated refractory hanger for holding refractory brick wherein the refractory hanger engages the hanger flanges of the refractory brick at approximately 90° to its engagement of the flange of the hanger beams.

It is yet another object of this invention to provide a refractory hanger which provides for expansion of the structure and has greater tolerances with respect to brick size and assembly as well as in the beams.

It is still another object of this invention to provide a refractory hanger wherein the portion in contact with the refractory brick is fabricated of a heat-resistant material and the portion in contact with the hanger beam is fabricated from a less expensive material.

It is still another object of this invention to provide one-piece hanger beam clips which require only "hand tightening" of fastenings.

Still other object of this invention will be readily apparent to one skilled in the art following references to the following description and the drawings showing preferred embodiments wherein:

FIG. 1 is a cross-sectional view at 90° to the axis of the hanger beams of a high temperature furnace structure of the prior art.

FIG. 2 is a cross-sectional view at 90° to the axis of the hanger beams showing one preferred embodiment of a furnace structure of this invention.

FIG.3 is a cross-sectional view at 90° to the axis of the support frame showing one embodiment of a furnace structure of this invention, as shown in FIG. 2.

FIG. 4 is a view of the hanger beam clips along the line shown as 4—4 in FIG. 3.

FIG. 5 is a displaced partly sectional view of the refractory hanger along the section shown as 5—5 in FIG. 3.

Referring to FIGS. 2 and 3, FIG. 3 being at right angles to FIG. 2, one preferred embodiment of the high temperature furnace construction of this invention is shown. While FIGS. 2 and 3 show a suspended roof construction according to this invention, it will be appreciated that the same construction may be used in monolithic refractory construction and tie-back wall construction. This invention also applies to refractory structures other than normal furnaces such as soaking pit covers, reheat furnaces, pelletizing furnaces, refractory lined reactors, refractory lined catalytic cracking units. This invention may apply to any type of refractory brick structure.

Referring to the figures, support frame 11 is shown as an I-beam. Any suitable support frame for externally supporting the weight of the structure is satisfactory. A plurality of hanger beams are inwardly spaced at approximately right angles to the support frame. The hanger beams are maintained in spaced relation along support frame 11 by one-piece hanger beam clips 30. The spacing can be readily adjusted to accommodate over and undersize brick.

Hanger beam clips 30 shown in FIGS. 2, 3 and 4, may be readily fabricated from structural steel tubing or formed by other well known metal forming techniques. The hanger beam clips may be formed from about 9 to about 13 gauge sheet steel, about 11 gauge being preferred. As best seen in FIG. 2, the hanger beam clips are of generally U-shape having opposing flanges 31 and 35 extending inwardly from the end of each leg of the U to engage flange 14 of hanger beam 12. The distance between the ends of opposing flanges 31 and 35 is sufficient so that the hanger beam clip may be placed over flange 14 by tilting it and inserting a portion of the hanger beam flange within the hanger beam clip diagonally far enough so that the hanger beam clip may be positioned so that the flange 14 engages both flanges 35 and 31. The side of the hanger beam clip joining the legs has lip portion 33 sufficiently long to engage flange 16 of support frame 11. When the hanger beam clip is in its desired position as shown in FIGS. 2–4, machine screw 34 is hand tightened against flange 14 by its coaction with nut 36. Prior art clips as shown in FIG. 1 require the screw and nut to be tightened with wrenches and even then vibration may loosen causing the hanger beam to fall from the clip. The hanger beam clips of this invention require only hand tightening of the screw since added weight tightens the clips. One hanger beam clip is placed on each side of flange 16 of support frame 11 holding hanger beam 12 in fixed position.

Right angle refractory hanger 40 comprises two interlocked opposing U-shaped portion 42 and 45. U-shape portion 42 has opposing flanges 41 and 47 extending inwardly from the end of each leg of the U to engage flange 15 of hanger beam 12. The ends of opposing flanges 41 and 47 are spaced sufficiently so that flange 15 may be inserted within U-shaped portion 42 by obliquely placing flange 15 within the space between the ends of flanges 41 and 47 and then turning the refractory hanger so that flange 41 and flange 47 engage opposite sides of flange 15. Side 43 of U-shaped section 42 connecting the legs opposite the opening between flanges 41 and 47, engages side 44 of second U-shaped portion 45 opposite the opening between flanges 46 and 48. Flanges 46 and 48 engage hanger flanges 16 of refractory brick 13. The shape of flanges 46 and 48 may be readily modified to engage the shape of the hanger flanges on different refractory bricks. For example, it is seen most clearly from FIG. 3 that the width of inverted U-portion 45 may be appropriate to have approximately horizontal flat inner portions of flanges 46 and 48 engage the horizontally flat portions of the hanger flanges which are on the extreme exterior portion of refractory brick 13. It is clear that the second U-portion 45 may be readily changed in dimensions and the angle of the flanges so as to engage the sloping portions of hanger flanges in the central portion of a refractory brick as shown in FIG. 1. By the term "hanger flanges" of the refractory brick as used throughout this description and claims, I mean the portion of the refractory brick which is held by or adjacent to the refractory hanger.

The width of U-shaped portion 42 and U-shaped portion 45 may be varied to most advantageously engage the particular flange shape and dimensions of the hanger beam utilized and the particular shape and dimensions of the hanger flanges on the refractory bricks utilized. The only limitations on such widths is the requirement that sides 43 and 44 opposite each of the openings of the U-shaped structures fit within the engaging U-shaped structure as shown. This, of course, may be achieved by narrowing of the U-shaped structure in the portions where one U-shaped portion engages the other. If desired, wall 44 may be fastened to wall 43 by tack welding or other suitable means to form a single refractory hanger for expeditious use in construction. However, it is not necessary that the inverted U-shaped portions be so attached. The design of the interlocking refractory hanger of this invention provides that even if any fastening of the two U-shaped portions fails, there is not any structural failure.

Each of the U-shaped portions of the refractory hanger may be fabricated from structural tubing or sheet metal roll formed shaped or may be fabricated from sheet metal by conventional forming methods well known to the art. The refractory hangers may be formed from metals of about 9 to about 13 gauge, about 11 gauge being preferred. Another advantage of the refractory hanger of this invention is that the U-shaped portion in contact with the refractory brick may be fabricated from stainless steel to resist heat and oxidation while the other U-shaped portion, which is not exposed to such intense heat, may be fabricated from less expensive carbon steel. It is apparent that any combination of desired metals may be used for each of the U-shaped portions of the refractory hanger of this invention.

The combination of the hanger beam clips and refractory hangers of this invention provide a floating or non-rigid structure which readily allows for variations in refractory brick dimensions and expansion upon heating. The structure also readily accommodates somewhat bent hanger heams which have proved troublesome during erection of structures used previously. The fabricated or sheet metal hanger beam clips and refractory hangers of this invention are lighter in weight than the presently used castings providing more economical and safer components.

I have found that the hanger beam clips and refractory hangers of this invention provide an economical, more easily erected and more trouble-free high temperature refractory structure than the conventionally used cast clips and refractory hangers as shown in FIG. 1.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. High temperature refractory structure having refractory brick lining including a support frame; a plurality of space hanger beams inwardly from said support frame and having opposed flanges; a plurality of spaced structural plate hanger beam clips engaging one of said hanger beam flanges for attachment to said support frame; a plurality of structural plate refractory hangers having two interlocked opposing U-shaped portions, one of the U-shaped portions engaging the other of said hanger beam flanges; and a plurality of refractory brick supported by said refractory hangers; the other of the U-shaped portions of said refractory hangers engaging hanger flanges of refractory bricks thereby supporting said refractory brick lining, said refractory brick hanger flanges being at approximately right angles to said hanger beam flanges.

2. The structure of claim 1 wherein said hanger beam clip comprises a substantially U-shape having opposing flanges extending inwardly from the end of each leg of said U-shape for engagement with one flange of said hanger beam, a lip extending from the side joining said legs and engaging a flange of said support frame, and a set screw extending through said side of the beam clip joining said legs which when tightened through a nut adjacent the inside of said side joining the legs of said U-shape urges the end of said screw against one side of the flange of said hanger beam and said inwardly extending flanges against the other side of said hanger beam flange holding said beam clip firmly engaged to said hanger beam.

3. The structure of claim 2 wherein said beam clip is sheet metal of about 9 to about 13 gauge metal.

4. The structure of claim 1 wherein said refractory hanger comprises two interlocked U-shapes having their axis at about right angles to each other, one of said U-shapes having opposing flanges extending inwardly from the end of each leg engaging a flange of said hanger beam and the side connecting the other end of said legs engaging at about a right angle the corresponding side of the second U-shape, the second of said U-shapes having opposing flanges extending inwardly from the end of each leg engaging said hanger flanges of the refractory brick.

5. The structure of claim 4 wherein said refractory hanger is sheet metal of about 9 to about 13 gauge.

6. The structure of claim 5 wherein said U-shape engaging a flange of said hanger beam is mild carbon steel and said U-shape engaging said refractory brick hanger flanges is stainless steel.

7. An improved sheet metal refractory hanger comprising two interlocked U-shapes having their axis at about right angles to each other, one of said U-shapes having opposing flanges extending inwardly from the end of each leg for engaging a beam flange and the side connecting the other end of said legs engaging at about a right angle the corresponding side of the second U-shape, the second U-shape having opposing flanges extending inwardly from the end of each leg for engaging hanger flanges of a refractory brick.

8. The hanger of claim 7 wherein said sheet metal is about 9 to about 13 gauge.

9. An improved sheet metal beam clip comprising a substantially U-shape having opposing flanges extending inwardly from the end of each leg of said U-shape for engagement with a flange of a first beam, a lip extending from the side joining said legs and engaging a flange of a second beam, and a set screw extending through said side of the beam clip joining said legs which when tightened through a nut adjacent the inside of said side joining the legs of said U-shape urges the end of said screw against one side of the flange of said first beam and said inwardly extending flanges against the other side of said first beam flange holding said beam clip firmly engaged to said first beam.

10. The beam clip of claim 9 wherein said sheet metal is about 9 to about 13 gauge metal.

* * * * *